United States Patent [19]

Baruffa

[11] 4,190,008

[45] Feb. 26, 1980

[54] ZIGZAG STITCH SEWING MACHINE

[75] Inventor: Olindo Baruffa, Thonex, Switzerland

[73] Assignee: Mefina S.A., Fribourg, Switzerland

[21] Appl. No.: 970,158

[22] Filed: Dec. 18, 1978

[30] Foreign Application Priority Data

Dec. 22, 1977 [CH] Switzerland ..... 15855/77

[51] Int. Cl.[2] ..... D05B 3/00

[52] U.S. Cl. ..... 112/158 B

[58] Field of Search ..... 112/158 B, 158 A, 158 R

[56] References Cited

U.S. PATENT DOCUMENTS

| | | | |
|---|---|---|---|
| 3,522,781 | 8/1970 | Baruffa | 112/158 B |
| 3,762,349 | 10/1973 | Fresard et al. | 112/158 B |
| 4,077,341 | 3/1978 | Kasuga | 112/158 B |

*Primary Examiner*—Peter P. Nerbun

*Attorney, Agent, or Firm*—Emory L. Groff, Jr.

[57] ABSTRACT

A zig-zag stitch sewing machine having a laterally displaceable needle, the displacements of the needle being controlled by a cam arrangement through a linkage mechanism, the cam arrangement being actuated by one or more control members, the linkage arrangement including a pivotally mounted slider, the pivotal axis for the slider being provided on a pivotal lever so that the pivotal axis is displaceable, and a connecting rod which is pivotally connected to the mounting for the needle, the connecting rod being displaceable along the slider, means being provided for displacing the pivotal axis of the slider while its free end is immobilized in one of its terminal angular positions, whereby displacement of the end of the connecting rod along the slider causes a needle carrying bar to be displaced between two terminal decentered positions.

4 Claims, 12 Drawing Figures

ZIGZAG STITCH SEWING MACHINE

The invention relates to a zig-zag stitch sewing machine.

According to the present invention, there is provided a zig-zag stitch sewing machine in which lateral displacement of the needle is controlled by a selected cam of a plurality of cams mounted on a common shaft, the selected cam being rotatable with the common shaft, the common shaft being rotatably driven by a main drive shaft for the machine so as to ensure reciprocating movement of a needle carrying bar mounted in a pivotable cradle, the selected cam controlling the pivotal movement of the cradle through the intermediary of a slider provided with a feeler which is pivotably mounted around an axis mounted on a first pivotable lever and with a connecting rod pivotally connected at a first end to the pivotable cradle, the second end of the rod being in contact with the slider and displaceable therealong by a second lever pivotally mounted on the cam shaft and means for displacing the pivotal axis of the slider while its free end is immobilized in a terminal angular position, whereby displacement of the said second end of the connecting rod along the slider causes the needle carrying bar to be displaced between two terminal decentered positions.

The invention will be further described, by way of example, with reference to the accompanying drawings, in which.

Figure 1:
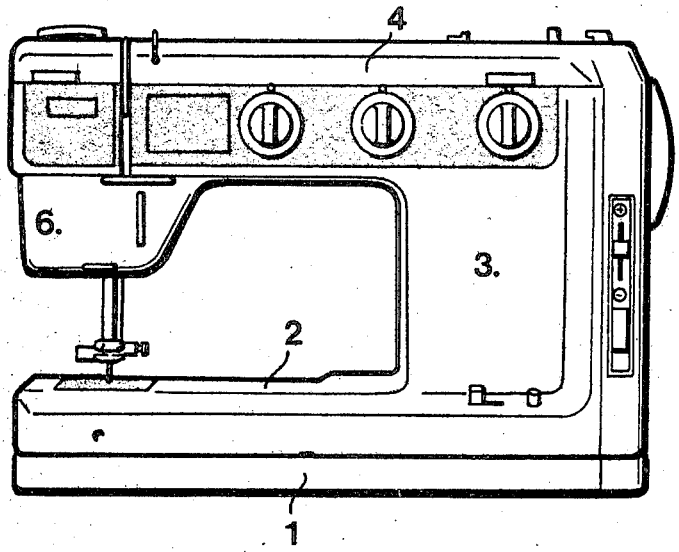
FIG. 1 is an elevational view of a sewing machine in accordance with the present invention.

Referring firstly to FIG. 1, a frame of a sewing machine comprises a base 1 above which is a free arm 2 containing the drive mechanism for the carrier of the machine, a column 3 housing an electric motor and an upper arm 4 in which is housed a main drive shaft 5 coupled to the motor in the column 3. The upper arm 4, at its free end, has a head portion 6 in which a cradle is mounted. A needle carrying bar 8 is driven in the cradle with a substantially vertical reciprocating movement by means of the main drive shaft 5. The cradle 7 is itself pivotally mounted around the major axis of the needle carrying bar 8, its pivoting movement being controlled by a mechanism housed inside the upper arm 4.

This mechanism is operated by a desired cam selected from a plurality of cams 9 mounted on a common shaft, the cam being rotatable with the shaft. A pinion 10 is formed integrally with one end of this common shaft and meshes with a tangent screw fixed to the main drive shaft 5. The stack of cams 9 is thus rotatably driven by the shaft 5.

The mechanism for controlling the pivoting of the cradle comprises a slider 11 provided with a feeler 12 which contacts the selected cam. One end of a connecting rod 13 is pivotally mounted on the cradle 7. At its free end, the cradle 7 is provided with a feeler 14, which feeler is displaceable along the slider 11. This latter is pivotally mounted about an axis 15 which is itself mounted on a lever 16 pivotal about an axis 17 mounted on a plate 18 integral with the frame of the machine. The axes 15 and 17 are both orientated so as to lie parallel to the common shaft for the cams.

Figure 3:
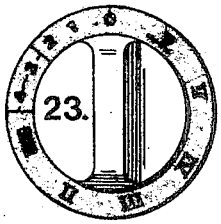
Figure 4:
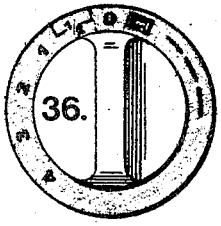
Figure 7:
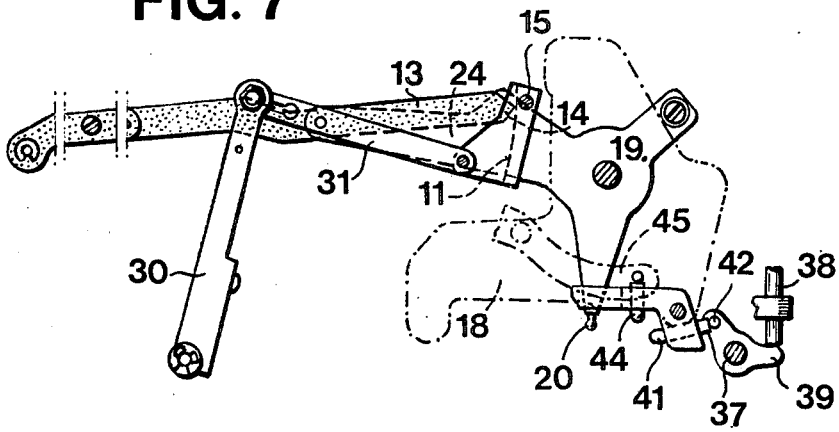
FIGS. 7 and 8 are partial plan views of the mechanism shown in FIG. 6, the views taken at two different levels.
Figure 10:
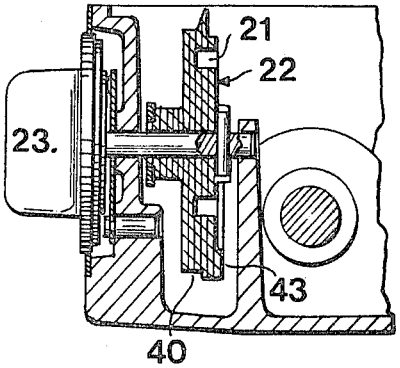
Figure 11:
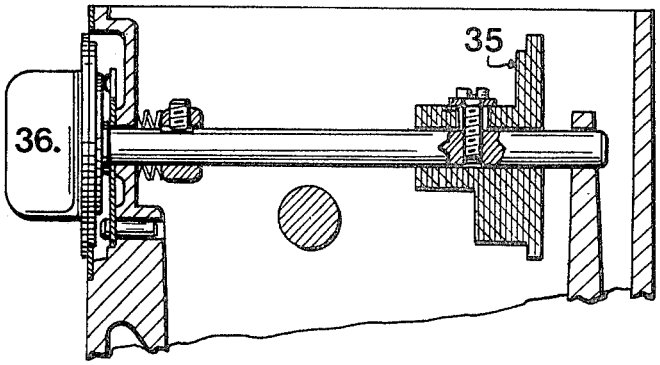

A lever 19, pivotal about this shaft between the plate 18 and the pinion 10, permits displacement of the feeler 14 along the slider 11. One of the arms 20 of the lever 19 is in contact with the profile 21 of a cam 22 manually operated by a control member 23 (seen in FIGS. 3 and 10). Another arm 24 of the lever 19 is pivotally connected to the connecting rod 13 carrying the feeler 14. In displacing the arm 20 of the lever 19 from left to right as seen in FIG. 7, the feeler 14 is displaced along the slider 11 in a direction from top to bottom of FIG. 7 by the arm 24 of the lever 19. To do this, the member 23 (FIG. 3) is rotated in a clockwise direction from position 0 to position 4. This displacement corresponds to a progressive increase in the stitch width, when the machine is set for zig-zag stitching controlled by a cam from the stack of cams 9.

Figure 2:
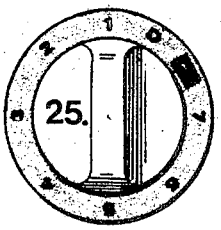
FIGS. 2, 3 and 4 are views, on an enlarged scale relative to FIG. 1, of details of the manual control members shown in FIG. 1.

The selection of a desired cam from the stack of cams 9 is effected by means of the control member 25 shown in FIG. 2. This operates a cam 26 having a double profile 27, 28 (best seen in FIGS. 5 and 9). The profile 27 controls the displacement of the feeler 12 along the stack of cams 9 through the intermediary of a lever 29 while the profile 28 removes the feeler 12 from the stack of cams 9 when its support 32 is displaced with respect to the stack of cams 9 through the intermediary of a lever 30 and a connecting rod 31 (see FIGS. 6 to 8). In rotating the member 25 in a clockwise direction, the feeler 12 is brought successively into contact with six different cams (positions 2 to 7 inclusive of the member 25), the cam in position 1 corresponding to simple zigzag stitching.

Figure 8:
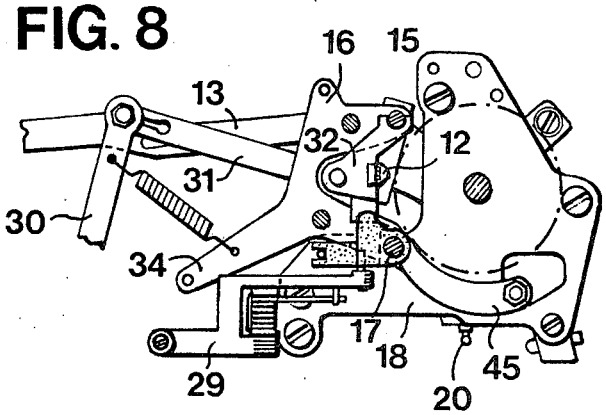
Figure 9:
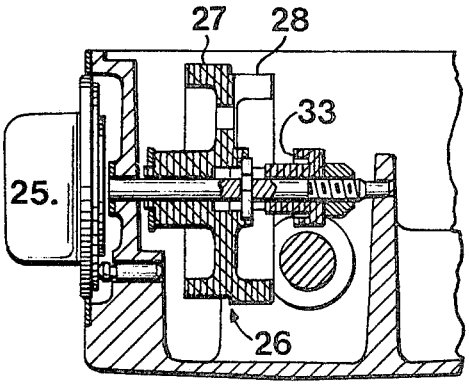
FIGS. 9, 10 and 11 are axial sectional views of various control cams of the mechanism, which cams are operated by the manual control members shown in FIGS. 2, 3 and 4 respectively.

In addition to the cam 26, the member 25 controls a cam 33 in contact with a cam follower mounted at the end of one of the arms 34 of the lever 16. This cam 33 maintains the pivotal axis 15 of the slider 11 in a centered position when the control member is set to any of the positions 1 to 7, but permits its decentering to the right (as seen in FIG. 8) corresponding to a decentering to the left of the needle carrying bar 8 when the control member 25 is rotated to a position between the markings D and 7. This position is used for stitching the left lip of a button hole.

In the position D of the button 25, the decentering to the left of the needle carrying bar 8 is accompanied by a removal of the feeler 12 from the stack of cams 9 caused by the profile 28 of the cam 26.

If the member 25 is in the D position, and the button 23 (FIG. 3) is rotated in a clockwise direction between the positions 0 and 4, the feeler 14 is displaced along the slider 11 in a direction from top to bottom as seen in FIG. 7 which causes a gradual displacement of the needle carrying bar 8 from a left-decentered position to a right-decentered position.

It is, of course, possible to effect such a gradual decentering of the needle carrying bar 8 in the opposite direction, that is to say, from a right-decentered position to a left-decentered position, by providing, in the stack of cams 9, a cam having a circular profile, the diameter of which corresponds to the minimum diameter of the other cams. The feeler 12 would remain in contact with the profile of one of the stack of cams, and the circular cam would act solely as an abutment. Thus, if the control member 25 was in its 7-position, the cam 35 would simultaneously operate the arm 34 of the lever 16 so as to decenter the pivotal axis of the slider 11 to the left of FIG. 8, this corresponding to a decentering to the right of the needle carrying bar 8. It then suffices to rotate the member 23 (FIG. 3) in a clockwise direction between its 0- and 4-positions to effect a gradual displacement of the needle carrying bar 8 from a decentered left position to a decentered right position.

Figure 5:
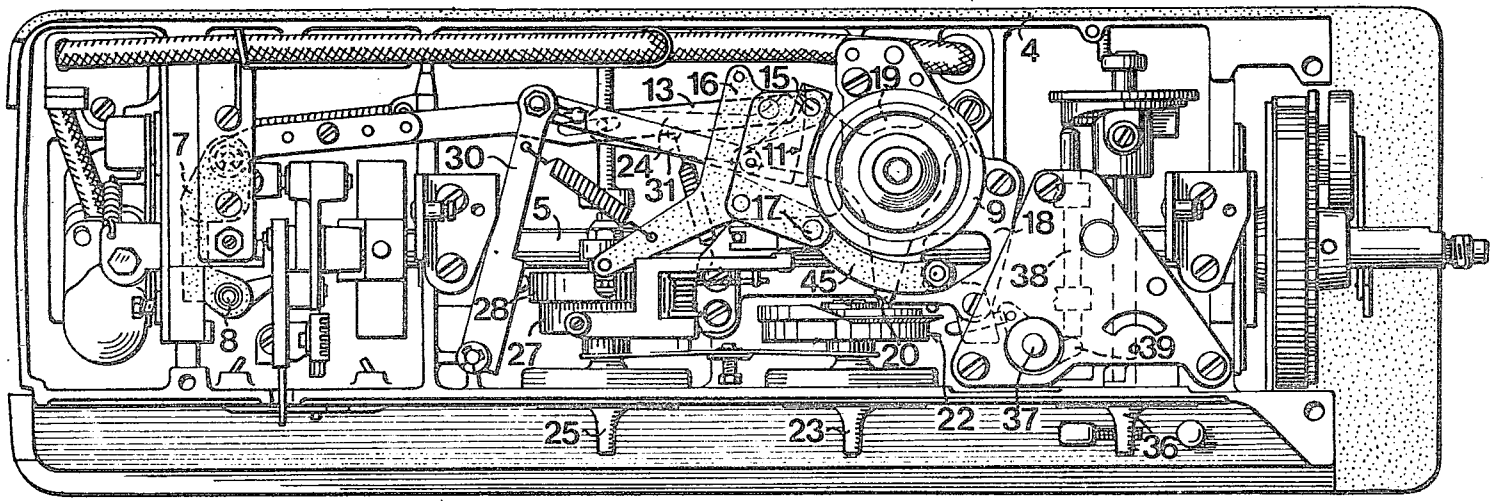
FIG. 5 is a plan view, on an enlarged scale relative to FIG. 1 showing a part of the mechanism of the machine, the cover for the upper arm of the machine having been removed.
Figure 6:
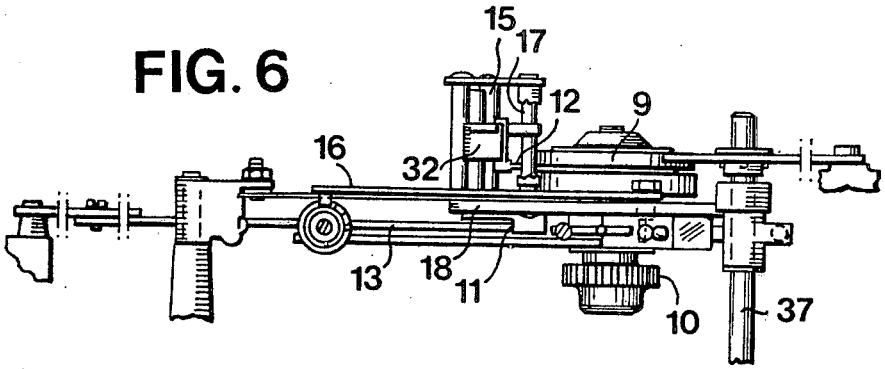
FIG. 6 is an elevational view of part of the mechanism shown in FIG. 5.

The stack of cams 9 also includes cams for controlling the movements of the carrier foot for the material to be sewn, which foot is housed in the free arm 2 and is driven by the main drive shaft 5. The amplitude and direction of displacement of this foot are controlled by a cam 35 manually operable by a member 36, as is described in U.S. Pat. application No. 862,982, dated Dec. 21, 1977. This control is effected by means of a rod 37 which extends substantially vertically but can occupy a number of different angular positions. Thus, in rotating the member 36 in a clockwise direction from the 0-position, the length of the forward stitch is increased. By rotating this member in an anti-clockwise direction, reverse carriage is achieved and the length of the reverse stitch is progressively increased. As shown in FIG. 5, manual adjustment of the direction and of the amplitude of the carriage of the material to be sewn is effected by the cam 35 through a pusher 38 axially guided in the direction of an arm 39 integral with the rod 37.

A machine of this type permits the automatic stitching of a button-hole. To do this, one proceeds in the following manner:

(A1) The needle carrying bar 8 is decentered to the left for the stitching of the left lip of the button hole by rotating the member 25 to the button-holing position (between the D- and 7- positions).

(A2) The member 36 is rotated to its button-holing position. The carriage of the material is thus adjusted with regard to the length of stitch required for the sewing of the botton hole, but in a reverse direction.

(A3) The member 23 is rotated to its button-holing position. The end 20 of the lever 19 is thus pushed towards the right as seen in FIG. 7 by a profile 21 of the cam 22 for stitching the left lip of the button hole, while a profile 40 of this cam 22 operates a pusher 41 which operates on an arm 42 of the rod 37 to bring it into the forward carrying position.

(B) The member 23 is then rotated in a clockwise direction into position II. This pushes the end 20 of the lever 19 further towards the right as seen in FIG. 7, and increases the width of the stitch. Simultaneously, the pressure exerted by the profile 40 of the cam 22 on the pusher 41 and on the arm 42 of the rod 37 is released, and the rod 37 comes back into the reverse carrying position, the arm 39 thereof coming into abutment with the opposing end of the pusher 38. One side of a button-hole is thus sewn in reverse.

(C) The member 23 is rotated in a clockwise direction into position III. This brings back the end 20 of the lever 19 into the position described in (A3) above while a profile 43 of the cam 22 acts on a pusher 44 which, in turn, acts on the end of an arm 45 of the lever 16 and decenters the needle carrying bar to the right. The right lip of the button-hole is then sewn in reverse.

(D) The member 23 is further rotated in a clockwise direction into position IV, which again has the effect of pushing the end 20 of the lever 19 further to the right as seen in FIG. 7 and increases the stitch width as described in (B) hereinbefore. The profile 43 of the cam 22 continues to actuate the pusher 44 which operates on the end of the arm 45 of the lever 16 and decenters the needle carrying bar to the right. The other side of the button hole is thus sewn in reverse.

(E) The member 23 is then rotated in a clockwise direction into position V, which brings the end 20 of the lever 19 back to the left, into the position shown in FIG. 8, the feeler 14 thus being brought back into its position shown in FIG. 7 representing a stitch width of zero. The profile 43 of the cam 22 acts on the pusher 44 and thus the end of the arm 45 of the lever 16 is not acted upon so that the needle carrying bar is again decentered to the left into the position described in (A1) hereinbefore. On the other hand, the profile 40 of the cam 22 actuates the pusher 41 to again act on the arm 42 of the rod 37 to bring it back into a forward carrying position which is however less than during the stitching of the left lip of the button-hole as described in (A3) hereinbefore. The finishing stitch of the button hole is then sewn.

Figure 12:
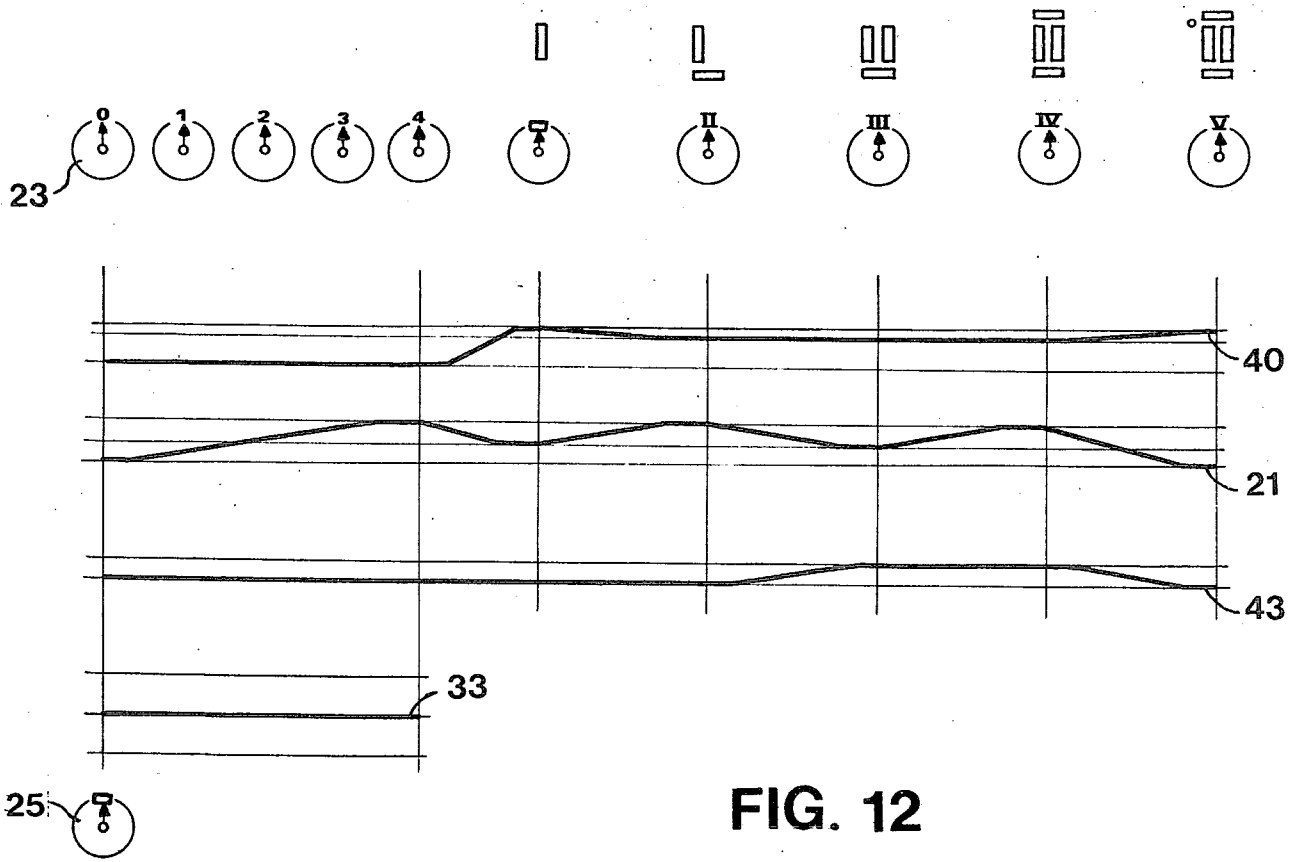
FIG. 12 is a developed view of the three profiles of the cam shown in FIG. 10.

In FIG. 12 there are shown developments of the profiles of the cams 21, 40 and 43 of the cam 22 operated by the member 23, and that of the cam 33 operated by the member 25 which intervenes during the sewing of a zig-zag stitch of increasing width from positions 0 to 4 of the button 23. There is also shown, in continuation, the profiles of the cams 21, 40 and 43 of the cam 22 operated by the member 23 occuring during automatic stitching of a button-hole in the manner described hereinbefore.

I claim:

1. A zig-zag stitch sewing machine comprising a laterally displaceable needle, a reciprocatable carrier bar for said needle, said carrier bar having a central position and two terminal decentered positions, pivotable cradle means for said reciprocatable carrier bar, a connecting rod having first and second ends pivotally connected, at said first end, to said cradle means, a pivotable slider contactable with said second end of said rod, lever means for displacing said second end of said rod along said slider, a pivot axis for said slider, said pivot axis being displaceable, pivotable lever means carrying said pivot axis for said slider such that said pivot axis has a free end, said slider carrying feeler means, cam means contactable with said feeler means, a cam shaft for said cam means, drive means for said cam shaft, selector means for selecting a desired cam from said cam means and means for displacing said pivotal axis of said slider while said free end of said pivot axis is immobilized in a terminal angular position whereby displacement of said second end of said connecting rod along said slider causes the needle carrying bar to be displaced between said two terminal decentered positions.

2. A machine as claimed in claim 1, wherein said means for displacing said pivotal axis of said slider comprises a first operating portion of said pivotable lever for displacing said axis in a direction towards said cam shaft, while said feeler is spaced apart from said cam rotatable with said cam shaft.

3. A machine as claimed in claim 2 wherein said first operating portion of the said pivotal lever comprises a first cam, said slider carries a second cam for removing said feeler, said feeler being controllably displaceable by displacement means in a direction parallel to said cam shaft, said displacement means comprising a third cam, said first, second and third cams being co-axially mounted, said selector means comprising a shaft, said shaft carrying a control member, said shaft constituting the common axis for said first, second and third cams.

4. A machine as claimed in claim 2 wherein said pivotal lever means includes a second operating portion, said second operating portion comprising a further cam arrangement, said arrangement comprising a cam profile, a shaft carrying said cam profile and a further control member mounted on said shaft, said cam profile co-operating with two further cam profiles for permitting automatic button-holing.

* * * * *